United States Patent [19]

Szanto et al.

[11] 4,354,405

[45] Oct. 19, 1982

[54] PUNCH EDGE GUIDE INDICATOR AND METHOD

[75] Inventors: Elmer G. Szanto, Saratoga; George Wu, San Jose; Salvatore Barone, Santa Cruz, all of Calif.

[73] Assignee: Velo-Bind, Inc., Sunnyvale, Calif.

[21] Appl. No.: 214,012

[22] Filed: Dec. 8, 1980

[51] Int. Cl.[3] ..... B26F 1/06

[52] U.S. Cl. ..... 83/13; 83/468; 83/522; 83/701; 29/463; 206/349

[58] Field of Search ..... 83/468, 467, 522, 446, 83/13, 701; 269/315; 33/494; 29/463, 464, 467; 206/349

[56] References Cited

U.S. PATENT DOCUMENTS

| | | | |
|---|---|---|---|
| 1,553,378 | 9/1925 | Harper | 83/468 X |
| 1,650,019 | 11/1927 | Kline | 83/468 |
| 1,692,779 | 11/1928 | Kline | 83/468 |
| 1,728,475 | 9/1929 | Cavill | 83/468 |
| 2,320,205 | 5/1943 | Wales | 83/522 X |
| 3,176,568 | 4/1965 | Bradley | 83/468 |
| 3,198,047 | 8/1965 | Monz | 83/33 |
| 3,322,014 | 5/1967 | Boragina et al. | 83/522 X |
| 3,469,486 | 9/1969 | Neilsen | 83/522 |
| 3,487,773 | 1/1970 | Meiar | 83/468 X |

*Primary Examiner*—James M. Meister

*Attorney, Agent, or Firm*—Julian Caplan

[57] ABSTRACT

For accurate correlation of the punch pins and edge guide for a paper punch or the like, a gage sheet of predetermined length is formed with accurately located holes corresponding to the desired location of the holes or slots to be punched in paper of similar length (e.g., end holes equidistant from top and bottom of the sheets). Such gage sheet may be pre-punched and of a permanent character, or may be prepared by trial and error by adjusting the edge guide until the end holes are equidistant from the edges of the sheet. The punch pins are lined up with the gage holes and then the edge guide is moved snugly against the edge of the gage. The gage is then removed. The edge guide is mounted on a transversely movable slide visible through a window in the platen on which the paper is to rest. Markings for different paper lengths may be permanently displayed on the platen at an edge of the window. Markings on the platen may be affixed by applying thereto a decal having paper length markings thereon. Accurate positioning of the edge guide after factory assembly is thus possible. In the preferred embodiment, a mark is placed on the slide in line with the marking on the platen corresponding to the particular length of the gage. Preferrably, such mark on the slide is affixed to a decal which is placed on the slide in the proper location.

8 Claims, 7 Drawing Figures

PUNCH EDGE GUIDE INDICATOR AND METHOD

This invention relates to a new and improved punch edge guide indicator and method of aligning same.

Paper punches and the like conventionally have an edge guide projecting up from the platen on which the papers to be punched rest so located that when the edges of the paper abut, the punch pins punch holes in the paper in proper location. Thus, preferably, the end holes are located equidistant from the top and bottom edges of the sheets being punched. Such edge guides are preferably transversely slideable to adjust for different lengths of paper. Heretofore, in order to accurately locate the punch holes relative to the edges of the paper, the operator must make several adjustments of the position of the edge guide. Several test punches are made on scrap sheets of paper and the edge guide readjusted after each test. This is time consuming and error encouraging.

Factory and post-factory positioning of the edge guide in exact relationship to the punch pins has heretofore been difficult because of tolerance accumulations in the dimensions of the parts of the apparatus. As the individual parts are assembled, the dimensional variations or tolerances accumulate so that the final alignment of the edge guide to a graduation line scribed or otherwise displayed on the platen is merely approximate and frequently in error.

In accordance with the present invention, it is unnecessary to attempt to maintain exact relationship with the graduation lines with the punch platen and the surface of the edge guide against which the paper is located. Instead, in accordance with the present invention a mark, whose position has been determined by a gage sheet, is made on the slide on which the edge guide is mounted to align with the adjacent marking on the platen.

In a preferred form of the invention, the mark on the slide of the edge guide is applied by attaching a decal having a preprinted line.

Accordingly, it is no longer necessary to strive for close tolerances in the dimensions of the punch parts, or the associated parts that position the paper to be punched in relation to the punch pins. Hence, by one simple calibration of the marking on the slide, accurate location of the punched holes relative to the edges of any sheet size is accomplished.

If, subsequent to initial adjustment, repairs or replacement of parts disturb the accuracy of the alignment, by removing the decal and replacing it with another in a new position, the apparatus may be re-calibrated.

Many punches accommodate different sizes of paper. The markings on the platen for these various sizes may be permanent, or semi-permanent, such as by superimposing another marking. However, by accurate location of a single mark on the slide of the edge guide, the equipment is accurate for any size paper. Hence, the operator can punch equidistant and properly positioned holes in any size paper merely by moving the edge guide so that the line on the slide is aligned with the proper size indication on the platen.

Other objects of the present invention will become apparent upon reading the following specification and referring to the accompanying drawings in which similar characters of reference represent corresponding parts in each of the several views.

Figure 1:
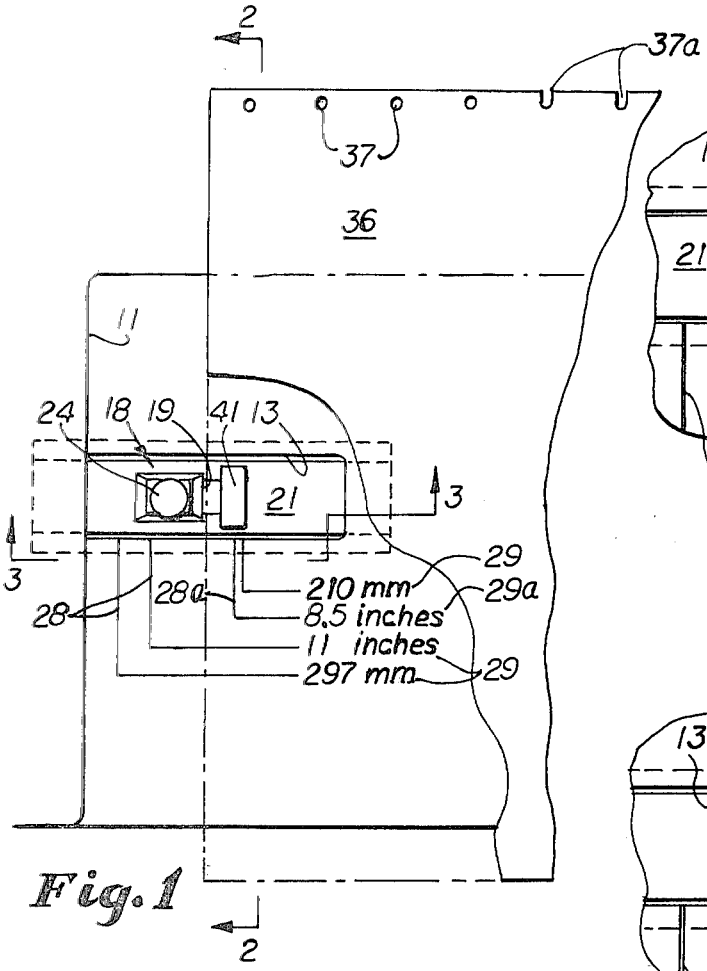
FIG. 1 is a schematic plan view of a portion of a punch showing use of the invention.

In the accompanying drawings, the invention is shown incorporated in a specific type punch; however, it should be understood that the invention has broader application in many different punch mechanisms.

As shown, the punch machine has a housing 11 in which is located a horizontal platen 12 upon which sheets to be punched rest. A transversely elongated window 13 is cut in the platen 12 adjacent one side edge thereof (the left side in conventional machines). Rearward of the window 13 is a punch mechanism 16 which is subject to considerable variation in structure. Reference is made to U.S. Pat. No. 4,079,467, for one punch mechanism with which the invention may be used. Such a punch has a throat 15 in which the leading edges of the papers to be punched are inserted. Vertically reciprocating in the throat 15 are punch pins 17 which perforate holes in the sheets being punched. In the aforesaid patent, there is a plurality of pins 17 equidistantly spaced across the machine. It is desirable that the holes punched at each end of a row of holes be equidistant from the edges of the sheet and the present invention has as its primary purpose the proper location of such holes.

Projecting upward through window 13 is a vertically disposed edge guide 18, the inner edge 19 of which is intended to function as a stop for lateral movement of sheets of paper stacked on platen 12. The guide 18 is mounted on a slide 21 resting on support 22 fixed to the frame of the machine. The slide 21, and hence the guide 18, may be moved laterally so that the papers to be punched when abutting the surface 19 are properly located relative to the pins 17 so that the holes are accurately punched.

Figure 3:
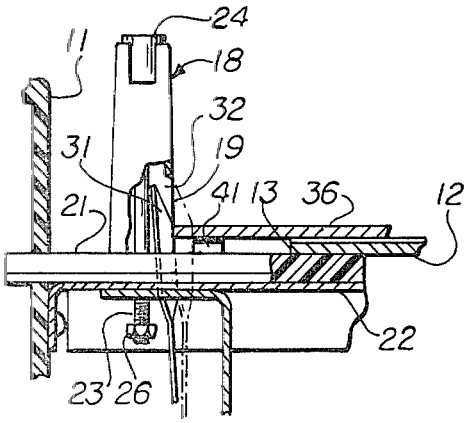
FIG. 3 is a sectional view taken substantially along the line 3—3 of FIG. 1.

Preferably, the guide 18 may be locked in position once it has been adjusted. In one form of the invention illustrated herein, there is a rotatable knob 24 located at the top of the guide 18 fixed to a threaded rod 23 and carrying a nut 26 at its lower end which secures the guide 18 in position by means not herein illustrated or described. The particular punch illustrated herein has means for automatic actuation of the punch mechanism when the sheets are accurately aligned and for this purpose has a switch actuator 31 projecting outwardly through a window 32 cut in the surface 19. Hence, when the paper is snug against the surface 19, the actuator 31 is moved from the dot-and-dash position of FIG. 3 to the solid line position of FIG. 3, thereby closing a switch (not shown) which initiates the punching action.

Permanent markings 28 are formed on the platen in proximity to the lower edge of the window 13 as viewed in FIG. 1. As shown in FIG. 1, four conventional paper lengths are set out as indicia 29 corresponding to each mark 28. Thus, the uppermost is "210 mm", the next "8.5 in.", the next "11 in." and the lowermost "297 mm". It will be understood that other and additional markings 28 and corresponding indicia 29 may be used.

In accordance with the present invention, a gage sheet 36 may be employed. This sheet 36 is of one of the conventional paper lengths such as 8½ inches. On its leading edge the gage sheet 36 is formed with accurately located holes 37 of the same diameter as are to be punched by the punch pins 17. Thus, the distance between the leftmost hole 37 in FIG. 1, from the left edge of the gage 36, is identical to the distance from the rightmost hole 37 from the right edge of the sheet (not shown).

Figure 4:
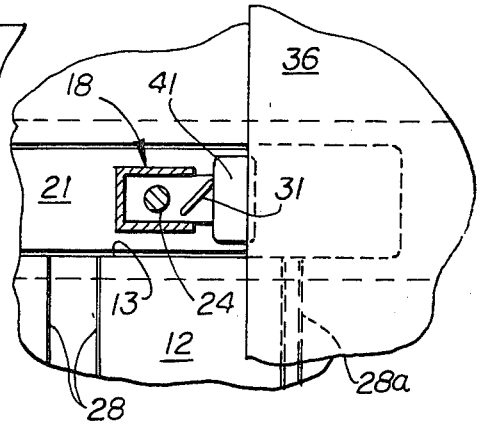
FIGS. 4, 5 and 6 are enlarged plan views of portions of FIG. 1 showing various stages in the use of the device.
Figure 5:
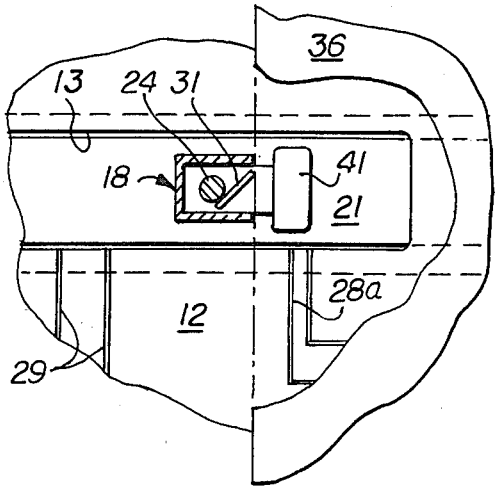
Figure 2:
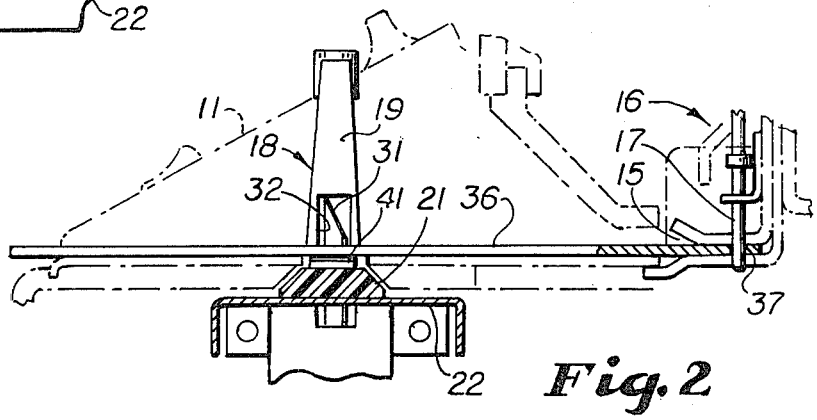
FIG. 2 is a sectional view taken substantially along the line 2—2 of FIG. 1.

With the guide 18 retracted as shown in FIG. 4, the gage 36 is positioned on the platen 12 and adjusted so that the holes 37 thereof receive the pins 17 when the punch is manually actuated. This operation is preferably conducted carefully so that the pins 17 do not damage the pre-punched holes 37. The punch pins 37 may be actuated and the cycle stopped when the punch pins are in the position shown in FIG. 2. The gage sheet, if it is formed with slots 37*a* (see right side of FIG. 1), may then be slid onto the pins so as to straddle them without possibility of damaging the gage sheet. When the gage 36 is accurately in place, the guide 18 is moved to the right as shown in FIG. 5 until the edge 19 abuts the left edge of the gage 36. Preferably, by turning the knob 24 the guide is locked in place. Gage 36 is then removed.

Figure 6:
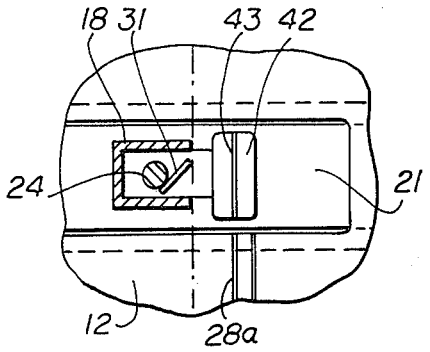

In the particular form of the invention illustrated herein, a boss 41 projects up from the surface of the slide 21 so that it is at an elevation about equal to that of the top surface of the platen 12. It has been assumed that the length of the gage 36 was 8½ inches. This corresponds to marking 28*a* and indicia 29*a*. A mark is then made on the boss 41 in alignment with the marking 28*a*. A preferred way of doing this is to use a decal 42 having a pre-printed line 43 thereon. The decal 42 is caused to adhere to the top of the boss 41 in such position that the line 43 is in alignment with the marking 28*a*. (See FIG. 6).

At any time in the future (barring any re-adjustment of the punch mechanism), at any time the operator wishes to punch 8½ inch paper, the guide 18 is slid so that the mark 43 coincides with the marking 28*a*.

The distance between the markings 28 is fixed and is independent of any tolerances or alignments of the punch mechanism. Hence when the operator wishes to use paper of other lengths, it is unnecessary to use a gage 36 of that particular dimension. It is merely necessary to align the line 43 with the particular marking 28 corresponding to the legend 29 of the paper which is to be punched.

When parts of the machine are adjusted or replaced, accuracy of alignment may be destroyed. In such case, a new mark 43 is applied employing the same procedure as the original application previously described.

Figure 7:
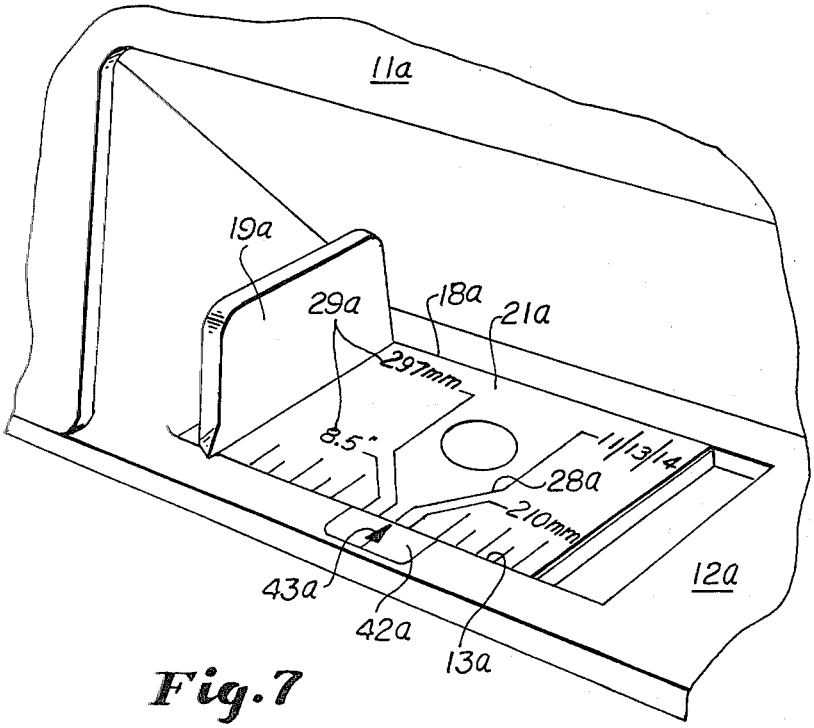
FIG. 7 is a perspective view of a modificator.

Referring to the modification shown in FIG. 7, housing 11*a* is formed with a paper punch platen 12*a* apertured in a window 13*a*. Edge guide 18*a* has a slide 21*a* visible through the window 13*a* and having an inner edge upright 19*a* against which the edge of the paper to be punched abuts. Permanent markings 28*a* are displayed on the slide 21*a* in proximity to one edge of the window 13*a*. Appropriate legends 29*a* (indicating the width of the sheets being punched) are associated with the markings 28*a*. A decal 42*a* having an arrow or line 43*a* is located on the platen 12*a* in proximity to the window 13*a* and alignable with the marking 28*a* which corresponds to whatever gage sheet size is utilized in setting the edge guide 18*a*.

In the form of the invention shown in FIG. 7, a gage sheet (not shown) similar to gage 36 described in connection with FIGS. 1–6 is used. The upstanding member 19*a* of slide 21*a* is brought into contact with the edge of the gage sheet. Thereupon, the decal 42*a* is applied to the platen 12*a* so that the arrow 43*a* points to the particular markings for the size sheet which has been aligned. Thus, either at the factory or in the field, a decal 42*a* may be applied and if adjustments are made in the punch a new decal 42*a* may replace that previously in place. It will be understood that the markings 28*a* and legends 29*a* are preferably printed or otherwise marked on another decal, rather than scribed on the slide 21*a*. Different decals for the legends 29*a* may be employed, depending upon the sizes of paper commonly used in the locality where the apparatus is to be sold.

As used in the accompanying claims, the term "hole" includes both holes 37 and slots 37*a*. If slots 37*a* are used, the gage sheet 31 is less likely to be damaged when the punch pins are moved downwardly. The pins may be depressed and then the gage sheet inserted in the punch throat and moved laterally so that the slots straddle the pins.

In a preferred practice of the invention a pre-punched or pre-slotted gage sheet 36 is used. Where not available, test sheets of paper are prepared by trial-and-error adjusting the edge guide position and punching sheets until a sheet is correctly punched—i.e., the end holes are equidistant from the ends of the sheet.

What is claimed is:

1. A kit for use with a punch, said punch being of the type having a platen member to support material of a given length to be punched, a plurality of punch pins disposed transversely across the inner end of said platen member to punch holes in said material, means for actuating said punch pins, said platen member being formed with a transverse window, an edge guide member for one edge of said material extending above the level of said platen, a support for said guide member supporting said guide member for movement along said window, first indicia means on a first of said members, second indicia means on a second of said members, said first and second indicia means being located on their respective members adjacent the margin of said window, said kit comprising at least one of said indicia means, which said indicia means is initially detached relative to said punch and a gage sheet corresponding to said given length punched with gage holes of the of the same dimension as the holes punched by said pins and at the same spacing as said pins, the endmost gage hole being the same distance from the edge of said gage sheet as the endmost hole in said material is spaced from the edge of said material when the endmost holes in said material are equidistantly located relative to the edge margins of said material, whereby said gage sheet may be adjusted on said platen member so that said pins fit into said gage holes and said edge guide member moved into contact with the edge of said gage, whereupon the initially detached indicia means may be fixed on the proper one of one said members aligned relative to the other said indicia means fixed on the other said member.

2. A kit according to claim 1 in which said initially detached indicia means is on said guide member.

3. A kit according to claim 1 in which said initially detached indicia means is on said platen member.

4. In a kit according to claim 3, wherein said initially detachable indicia means is fixed on said support and which further comprises additional indicia means fixed on said platen spaced along said margin of said window at fixed distances from said indicia means on said platen, whereby materials of different lengths are automatically equidistantly located relative to the end margins of said material once said initially detached indicia means has been fixed in position.

5. In a kit according to claim 4, which further comprises a slide below said platen member from which said guide member projects upward, said slide being visible through said window, said second indicia means being affixed to said slide.

6. In a kit according to claim 5, a boss on said slide extending up to about the level of said platen member, said second indicia means being affixed to said boss.

7. In a kit according to claim 3, in which said one said indicia means is a sticker carrying a marker line.

8. A method of setting the side edge guide of a punch for paper and other flexible material so that the endmost holes punched in said material are equally distant from the end margins of said material despite accumulations for tolerances in the assembly of parts for such punch, said punch having a platen formed with the transverse window, a plurality of punch pins spaced transversely across the inner end of said platen member to punch holes in said material, actuating means for actuating said punch pins, an edge guide for one edge of said material extending above the level of said platen, a support supporting said guide member for movement along said window, said platen being marked with first indicia indicating different lengths of material to be punched, said method comprising providing a gage sheet of a given length formed with gage holes of the same dimension as the holes punched by said pins and at the same spacing as said pins, said given length being of a length corresponding to one of said different lengths of material, the endmost gage hole being the same distance from the end of said gage sheet as the endmost hole in said material of given length is spaced relative to the edge margin of said material, actuating said actuating means so that said punch pins fit properly into said gage holes, adjusting the position of said edge guide to fit against the edge margin of said gage sheet, and applying second indicia to said support aligned with the particular one of said first indicia corresponding to the length of said gage sheet.

* * * * *